US009725891B2

(12) United States Patent
Morales

(10) Patent No.: US 9,725,891 B2
(45) Date of Patent: Aug. 8, 2017

(54) MIXING FAUCET PROVIDED WITH A FILTER

(71) Applicant: Duratex S.A., Sao-Paulo-Sp (BR)

(72) Inventor: Luiz Moquiuti Morales, Osasco-Sp (BR)

(73) Assignee: Duratex S.A., Sao-Paulo-Sp (BR)

( * ) Notice: Subject to any disclaimer, the term of this patent is extended or adjusted under 35 U.S.C. 154(b) by 460 days.

(21) Appl. No.: 14/347,119

(22) PCT Filed: Sep. 25, 2012

(86) PCT No.: PCT/BR2012/000378

§ 371 (c)(1),
(2) Date: Mar. 25, 2014

(87) PCT Pub. No.: WO2013/044339

PCT Pub. Date: Apr. 4, 2013

(65) Prior Publication Data

US 2014/0230143 A1 Aug. 21, 2014

(30) Foreign Application Priority Data

Sep. 26, 2011 (BR) ..... 1104487

(51) Int. Cl.
*E03C 1/04* (2006.01)

(52) U.S. Cl.
CPC ..... *E03C 1/0404* (2013.01); *E03C 1/04* (2013.01); *E03C 2201/40* (2013.01)

(58) Field of Classification Search
USPC ..... 4/678
See application file for complete search history.

(56) References Cited

U.S. PATENT DOCUMENTS 5,983,938 A 11/1999 Bowers et al.
6,179,130 B1 * 1/2001 Nguyen ..... F16K 11/076 137/801
6,219,860 B1 4/2001 Chang
(Continued)

FOREIGN PATENT DOCUMENTS

EP 1154083 A1 11/2001
WO 2012140526 A2 10/2012

OTHER PUBLICATIONS

International Search Report and Written Opinion dated Jan. 17, 2013, International Application No. PCT/BR2012/000378.

*Primary Examiner* — Lauren Crane
(74) *Attorney, Agent, or Firm* — Dinsmore & Shohl LLP

(57) ABSTRACT

The faucet comprises a body having a cold water inlet, a hot water inlet and a service water outlet, and housing a mono-control mechanism, for blocking and liberating the communication between the cold water inlet and/or hot water inlet with the service water outlet; a tubular column, coupled to the body and open to the service water outlet, and onto which is mounted a first head carrying a service radial spout connected to the service water outlet; a filter cartridge mounted in the interior of the tubular column, inferiorly connected to the cold water inlet and onto which is mounted a second head which carries a filtrate radial spout connected to the outlet nozzle of the filter cartridge; and a filtrate cock for blocking and liberating the fluid communication between the cold water inlet and the filtrate radial spout.

13 Claims, 8 Drawing Sheets

(56) References Cited

U.S. PATENT DOCUMENTS

| | | | | |
|---|---|---|---|---|
| 7,313,834 | B2 * | 1/2008 | Tan | E03C 1/0404 137/801 |
| 2009/0100594 | A1 * | 4/2009 | Chen | F16K 11/205 4/678 |

* cited by examiner

MIXING FAUCET PROVIDED WITH A FILTER

FIELD OF THE INVENTION

The present invention refers to a mixing faucet, which incorporates a filtering device provided with a replaceable filtering element, and which is designed to be mounted on a bench or on a wall of a building, in order to operate in kitchen sinks or in similar installations, allowing the user to obtain, by means of operational control cocks, a flow of service water, which can be cold, hot or mixed hot and cold water, and a flow of filtered water, said flows being independent from one another and having a controllable flowrate.

BACKGROUND OF THE INVENTION

The provision of a filtering device in a kitchen faucet has been achieved by means of different constructive arrangements which present, in common, the fact that the flow of filtered water is obtained through a filtering device hydraulically coupled to the body of the faucet, in the form of an external accessory, aesthetically dissociated from the design of the faucet and which presents a control cock with its own wheel and independent from the wheel of the faucet cock.

In these known constructive solutions, the filtering device is an element independent from the faucet, being coupled thereto only to use it as an element of structural support and water supply, from the same terminal of the hydraulic network.

Considering said prior art solutions, it can be observed that they rarely result in an aesthetically agreeable assembly, occupying a reduced space in the region where the faucet is installed in the kitchen sinks, jeopardizing the original design of the faucet. Moreover, these solutions, which use the filtering device externally aggregated to the faucet body, require the use of a large, number of components, increasing the cost of the product, which does not add benefits to the aesthetic of the assembly, neither facilitates the operation for the user.

As a function of the inconveniences cited above, it was proposed the faucet described and illustrated in the Brazilian patent application PI 0903624-5, of the same applicant, presenting a compact construction, which is aesthetically defined by the design of the faucet, and which allows the user to obtain, in movable and independent spouts, flows of service water and of filtered water, which are controlled, in an independent and alternative manner, through a single cock coupled to the faucet body.

In spite of the advantages of said prior art construction, it still presents some limitations related to the fact of not allowing the controlled mixture of the cold and hot water flows, and neither the simultaneous use of the spouts of service water and filtered water.

Besides the limitation mentioned above, the construction of the faucet, provided with a filter of said prior art patent application, requires the user to take the control cock to the closed position, before removing the filter to be replaced. In case the user forgets to close the cock, the removal of the filter will provoke the free and uncontrolled discharge of the flow of cold water from the hydraulic network in which the faucet is installed. In situations of high pressure in the hydraulic network, the disassembly of the filter, with the cock of the faucet being open, may cause large material damages by flooding the surrounding environment or by the filter cartridge being violently expelled from its housing in the faucet body.

SUMMARY OF THE INVENTION

As a function of the limitations of the solution for the faucet provided with a filter commented above, the present invention has the object of providing a mixing faucet, to be mounted in kitchen sinks or similar installations, and which allows the user, through a compact construction aesthetically defined by the faucet design, to obtain, in movable and independent spouts, a flow of cold, hot or mixed service water, and a flow of filtered water, said service water and filtered water flows being controlled, independently, through respective cocks coupled to the body of the faucet.

According to the invention, the faucet provided with a filter comprises a body having a cold water inlet, a hot water inlet, and a service water outlet, said body lodging a monocontrol mechanism, presenting both mixing and sealing functions, to be manually displaced between closing and opening positions, in which said mechanism blocks and liberates, respectively, the fluid communication, with a controllable flowrate, between at least one of the cold water and hot water inlets with the service water outlet.

It is also provided a generally vertical tubular column, having a lower end coupled to the body and open to the service water outlet, and an open upper end, onto which is mounted a first head carrying a service radial spout, which is maintained in fluid communication with the service water outlet through the tubular column.

A filter cartridge is mounted in the interior of the tubular column, in order to have a lower nozzle maintained in fluid communication with the cold water inlet, and an upper nozzle onto which is mounted a second head which carries a filtrate radial spout.

The faucet of the invention further comprises a filtered water cock, mounted in one of the parts defined by the body and by the second head and defining a selective fluid communication between the cold water inlet and the filtrate radial spout.

The filtered water cock is preferably mounted in the second head, defining a selective fluid communication between the outlet nozzle of the filter cartridge and the filtrate radial spout. Specially, but not exclusively, in this type of arrangement in which the filtered water cock is mounted upstream the filter cartridge, the present faucet is provided with a check valve to allow the fluid communication of the cold water inlet with the lower nozzle of the filter cartridge to be established only when the latter is already mounted and retained in the interior of the tubular column.

The construction defined above allows the mixing faucet to present, in the same structural body, two, radial spouts, which can be rotatively displaced in respective planes transversal to the tubular column, one of said spouts liberating service water, which can be either cold, hot or mixed, in a flow controlled by a monocontrol mechanism, and the other spout liberating, through an independent cock, a flow of filtered water coming from a replaceable filter cartridge.

The present mixing faucet allows the user to obtain, selectively and independently, a flow of filtered water and a flow of service water, cold, hot, or mixed, through the respective radial spouts.

Moreover, in the construction proposed herein, the mixing faucet may have its body and the tubular column configured jointly with the radial spouts, with the monocontrol mechanism and with the filtered water cock, according to different aesthetic projects, allowing obtaining an installation which occupies a reduced space in the kitchen, without impairing the aesthetic appearance of the assembly.

BRIEF DESCRIPTION OF THE DRAWINGS

The invention will be described below, with reference being made to the appended drawings, given by way of example of a possible embodiment of the invention, and in which.

DESCRIPTION OF THE INVENTION

Figure 1:
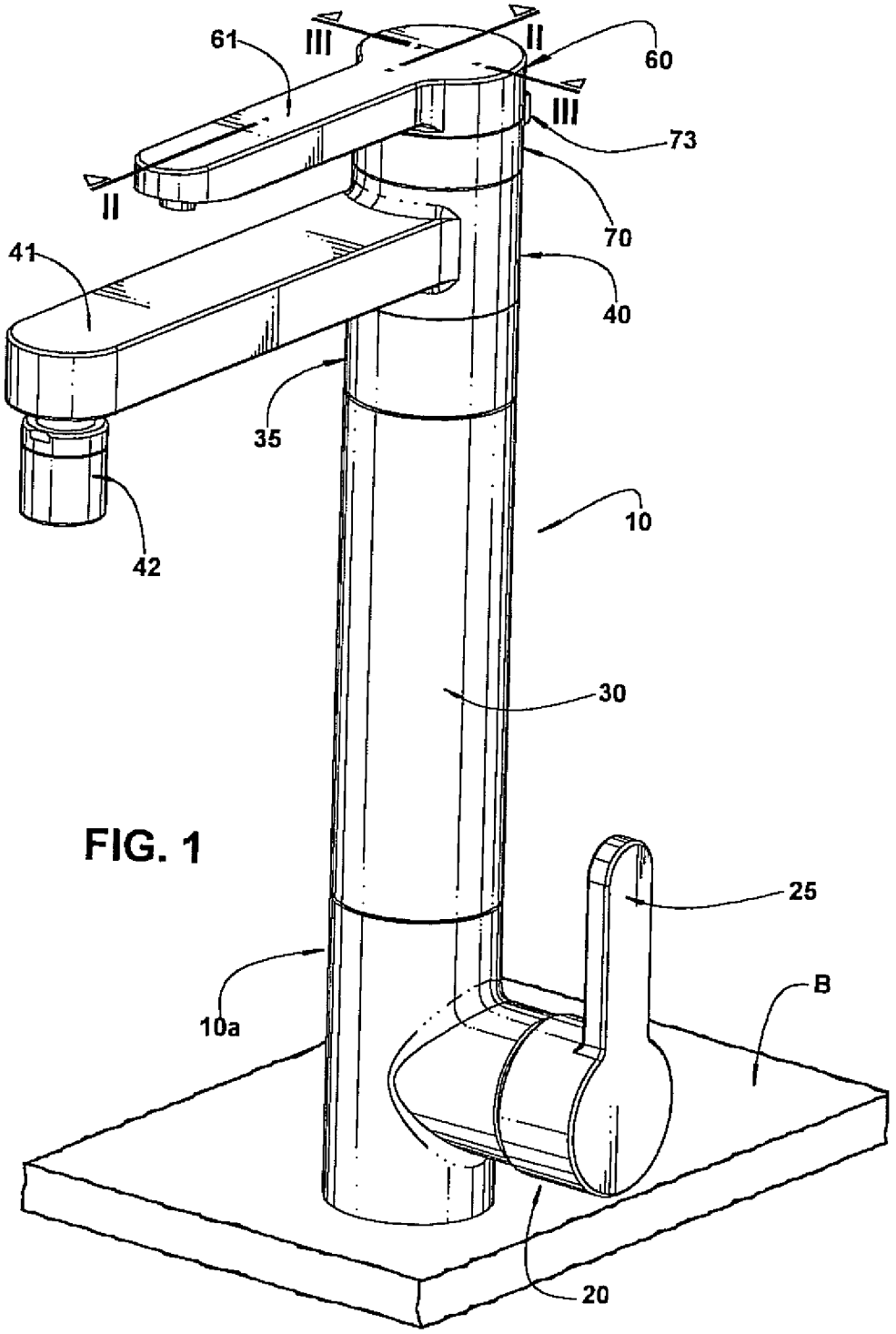
FIG. 1 represents a perspective view of the present faucet, mounted on a bench.

As illustrated in the appended drawings, the present mixing faucet is constructed to be usually installed on a bench B of a kitchen sink, although it is possible to apply it directly to the wall of a construction, it being only necessary that the faucet be provided with a body 10, generally in metal and configured to be orthogonally mounted to the horizontal terminal of the hydraulic network (not illustrated).

According to the illustrated construction, the body 10 has a cold water inlet 11 and a hot water inlet 12, both defined in a lower portion 10*a* of the body 10, which lower portion 10*a* is configured to be fitted and affixed, by well known means, through a corresponding hole (not illustrated) defined in said bench B. The cold water inlet 11 and hot water inlet 12, each have an inlet end 11*a*,12*a* and an outlet end 11*b*,12*b*, the inlet ends 11*a*, 12*a* being connected to the supply of cold water and hot water by means of an adequate, flexible, rigid or semi-rigid construction. The outlet ends 11*b*,12*b* of the cold water inlet 11 and hot water inlet 12 are open, in the axial direction, to the bottom of a cylindrical chamber 13 radially disposed in the body 10, having an end open to the outside of the latter, and an opposite end closed by a bottom wall 13*a*.

The body 10 further presents, in its interior and axially disposed, a service water outlet 14 having an inlet end 14*a*, open to the bottom wall 13*a* of the cylindrical chamber 13, and an outlet end 14*b* to be commented hereinafter.

In the interior of the cylindrical chamber 13 of the body 10 is mounted a monocontrol mechanism 20, with both a mixing function and a sealing function and designed to cooperate with the cold water and hot water inlets 11, 12, and with the service water outlet 14. The monocontrol mechanism 20 is constructed to be manually displaced, usually by an angular movement, between a closing position, in which it blocks the fluid communication of any or both of the cold water and hot water inlets 11, 12 with the service water outlet 14, and opening positions, in which it blocks, in an adjustable manner, the fluid communication of any or both of the cold water and hot water inlets 11, 12 with the service water outlet 14.

The monocontrol mechanism 20 is illustrated, in a schematic and simplified way, due to the fact that the specific construction thereof makes no part of the present invention, whereby it can be defined by any well known prior art means to provide a control for the cold and hot water flows carried out by a single mechanism or cock. In the illustrated constructive form, the monocontrol mechanism 20 is of the type defined by a replaceable cartridge, incorporating a head 21 which is affixed, by means of a thread, in the interior of the cylindrical chamber 13, and by a drive rod 22 to which is coupled a handle 25, which is usually displaceable, in an angular trajectory, in two directions orthogonal to each other, according to a well known operational arrangement. A tubular column 30, generally vertical and made of a metallic material, has a lower end 31, coupled to the body 10 and open to the service water outlet 14 of the latter, and an upper end 32 in which is mounted a first head 40, also preferably metallic and which carries, generally incorporated in a single piece, a service radial spout 41, disposed generally in a horizontal and preferably rotative way, and which is maintained in fluid communication with the service water outlet 14, of the body 10, through the first head 40 and through the tubular column 30.

The body 10 is provided, in an upper face against which is seated the lower end 31 of the tubular column 30, with an internally threaded axial recess 17, in whose bottom is defined an upper nozzle 17*a*, which is also internally threaded and has a smaller diameter.

The body 10 is also internally provided with a passage having an inlet end 15*a*, which is maintained constantly open to the cold water inlet 11, and an outlet end 15*b*, open to the outside of the body 10 in the interior of the upper nozzle 17*a*.

In the interior of the tubular column 30 is mounted, with a radial gap sufficient to form an annular conduct CA, a replaceable filter cartridge 50, which presents a lower nozzle 51, for water admission and which is open to the outlet end 15*b* of the passage 15, internal to the body 10, and an upper nozzle 52, for discharge of filtered water.

A second head 60, also preferably made of a metallic material, is mounted over the first head 40 and incorporates, generally in a single piece, a filtrate radial spout 61, for the discharge of filtered water and which is maintained in fluid communication with the outlet nozzle 52 of the filter cartridge 50, through the second head 60.

In the illustrated construction, the tubular column 30 has its lower end 31 externally threaded and engaged in the internally threaded axial recess 17 provided in the body 10, the tightness of this coupling being guaranteed by an elastomeric sealing ring 18 disposed around the lower end 31 of the tubular column 30, between the latter and the axial recess 17.

A sleeve 80 has an externally threaded lower end 81 engaged in the interior of the upper nozzle 17*a* of the body 10, and an open upper end 82 carrying, internally, an elastic sealing ring 83, said sleeve 80 carrying, inferiorly, a sealing ring 84, to be axially seated and pressed against the body 10, in the bottom of the axial recess 17 and in the interior of the upper nozzle 17*a*, around the outlet end 15*b* of the passage 15, which is thus maintained open to the interior of the lower end 81 of the sleeve 80.

The replaceable filter cartridge 50 comprises a tubular housing 54 lodging a filtering element 55, with a tubular form, presenting a blind axial hole 55*a* which is superiorly open to the upper nozzle 52 of the tubular housing 54, the latter defining, in an open lower end, the lower nozzle 51 of the filter cartridge 50 and, in the upper end, the upper nozzle 52 of the filter cartridge 50.

The open lower end 51 of the tubular housing 54 is tightly fitted in the interior of the sleeve 80, radially pressing the elastic sealing ring 83 against the sleeve 80, allowing the supply of cold water from the passage 15 to the interior of the lower nozzle 51 of the filter cartridge 50.

Figure 2:
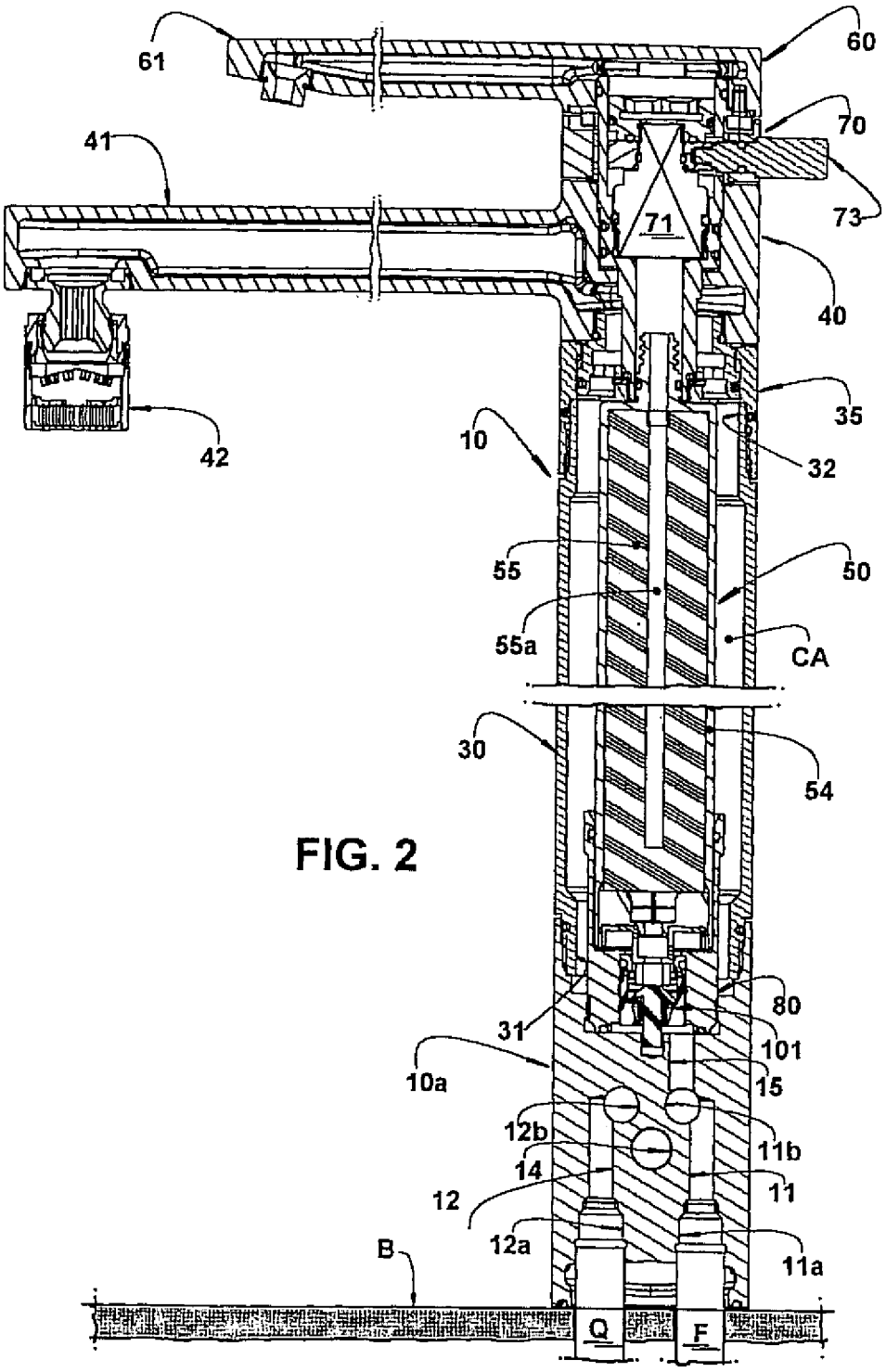
FIG. 2 represents a longitudinal sectional view of the faucet, taken according to line II-II in FIG. 1.
Figure 2A:
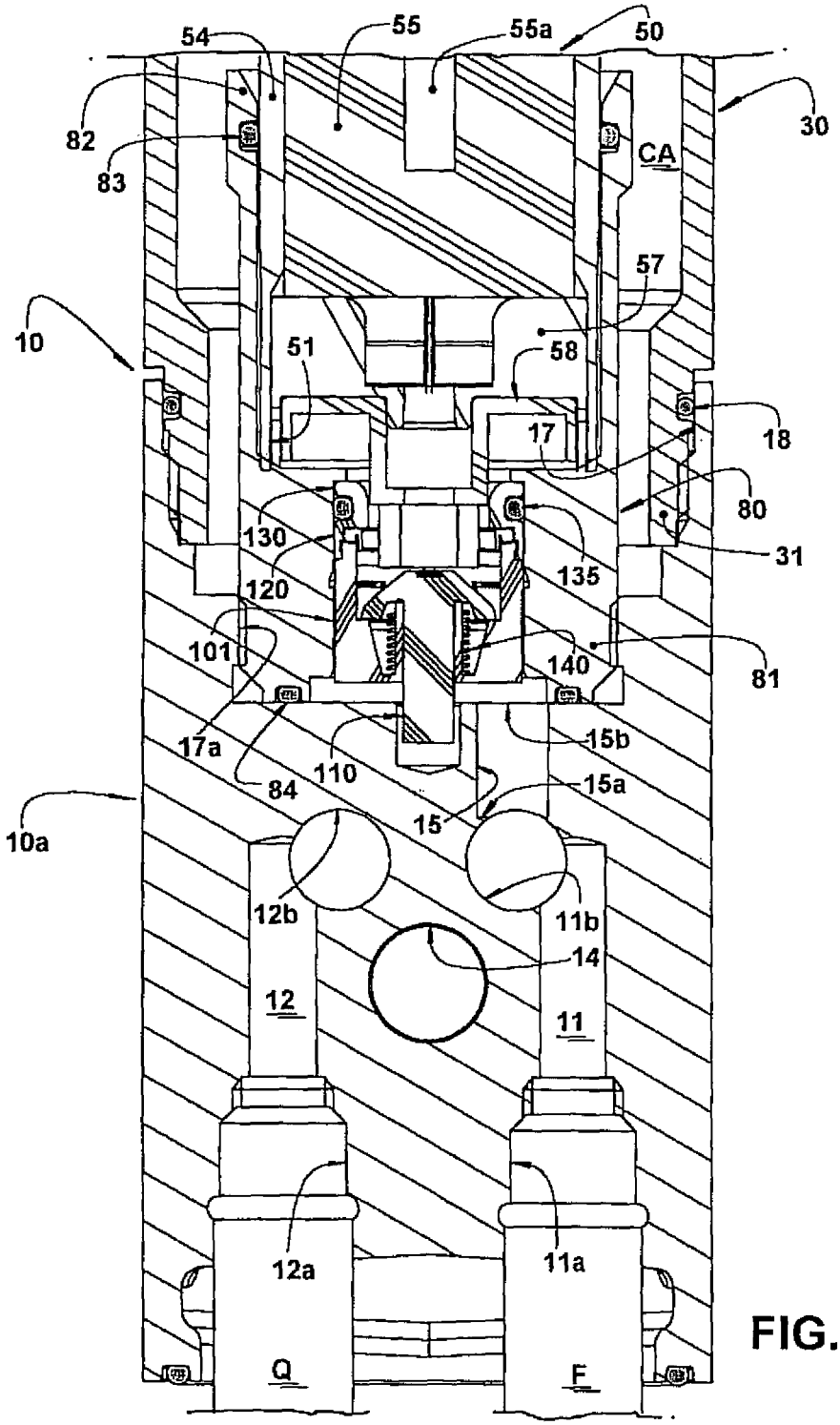
FIG. 2A represents an enlarged detail of the lower part of the faucet illustrated in FIG. 2.

As better illustrated in FIG. 2A, the lower end 51 of the filter cartridge 50 is fitted around a centrally open annular support 57, onto which is seated the filtering element 55, the annular support 57, on its turn, being seated over a tubular extender 58, whose function will be described ahead.

In the illustrated construction, a tubular column 30 has its upper end 32 externally threaded and tightly engaging, by means of a sealing ring 35*a*, a tubular jacket 35 which carries, internally, a tubular hub 36, having an upper cylindrical projection 36*a* around which is rotatively mounted the first head 40. The sealing between the tubular hub 36 and the head 40 is guaranteed by a sealing ring 36*b*.

The first head 40 is preferably tubular with open ends and with its interior open, through the tubular hub 36, to the interior of the service radial spout 41 and to the interior of the annular conduct CA, which is formed between the tubular column 30 and the filter cartridge 50.

The construction above allows the monocontrol mechanism 20 to control the flowrate of the cold, hot or mixed service water, which is conducted through the annular conduct CA, through the tubular hub 36 and through the first head 40, to the interior of the service radial spout 41, which is provided with a usual aeration tip 42. The tubular jacket 35 incorporates an inner circumferential projection 35*b* under which is seated a retaining ring 37 which, on its turn, is seated on an outer circumferential rib 36*c* of the tubular hub 36. Thus, the tubular hub 36 is axially retained in the interior of the tubular jacket 35 which, on its turn, is removably affixed, by a thread, to the upper end of the tubular housing 30.

The tubular hub 36 further incorporates an inner circumferential flange 36*d* provided with a plurality of through holes and under which is seated a nut 38, internally threaded and which is seated against an upper annular wall 54*a* of the tubular housing 54, defined around the upper nozzle 52 of the latter.

The present faucet further comprises a tubular rod 90, having a lower end 91, externally threaded and which is coupled in the threaded interior of the nut 38, around the upper nozzle 52 of the filter cartridge 50. The sealing between the lower end 91 of the tubular rod 90 and the parts of nut 38 and upper nozzle 52 is obtained by respective sealing rings 91*a* e 91*b*, generally elastomeric.

The tubular rod 90 extends upwards, through the tubular hub 36 and through the first head 40, ending up in an upper end 92, open and externally cylindrical, around which is rotatively mounted the second head 60 which carries the filtrate radial spout 61. The second head 60 is axially and inferiorly seated and affixed, by at least one bolt 93, onto an outer peripheral flange 94. A sealing between the second head 60 and the upper end 92 of the tubular rod 90 is achieved through at least one sealing ring 62, generally elastomeric.

Figure 2B:
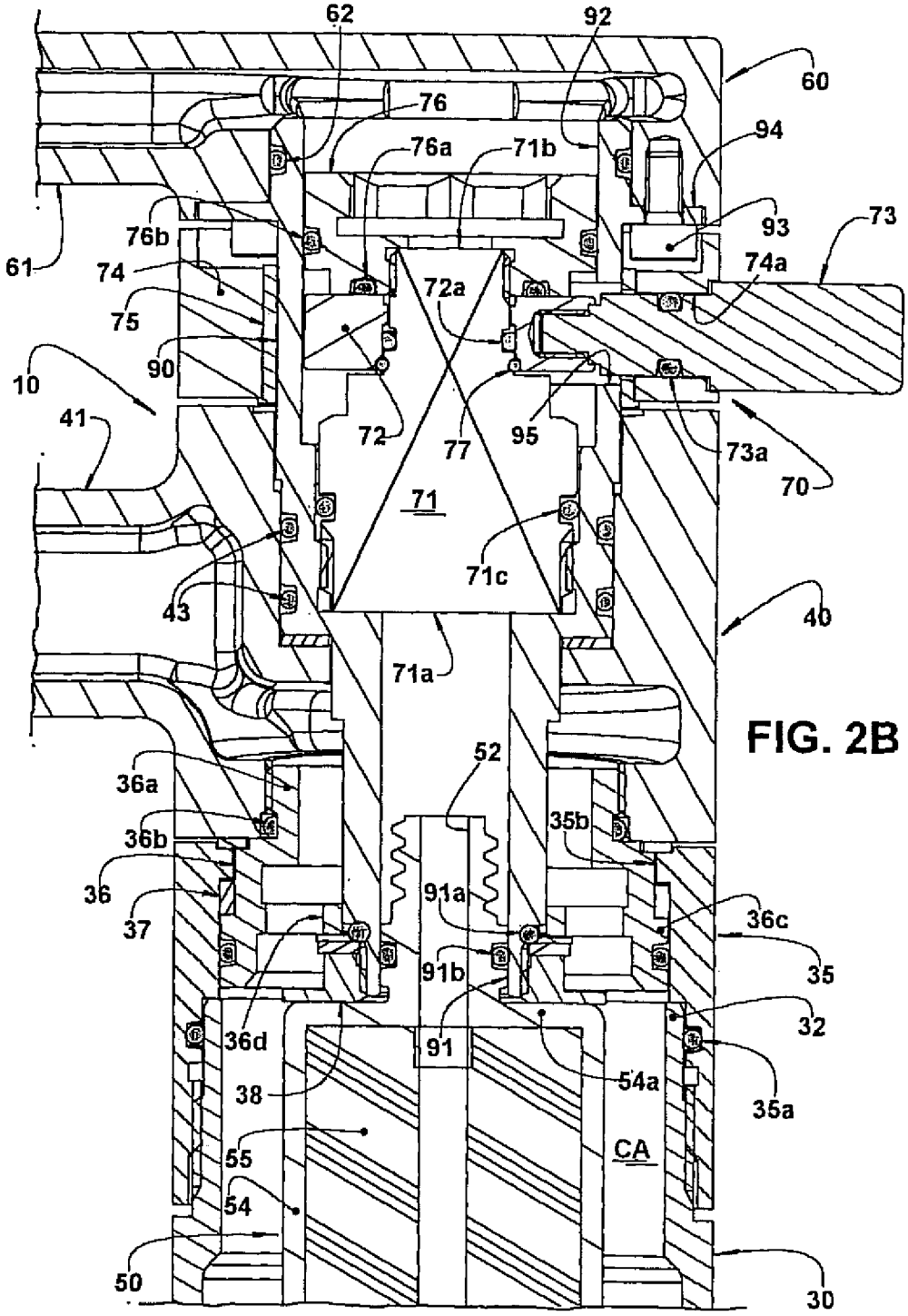
FIG. 2B represents an enlarged detail of the upper part of the faucet illustrated in FIG. 2.

As better illustrated in FIG. 2B, the first head 40 is rotatively mounted around a median cylindrical portion of the tubular rod 90, said second head 40 being sealed, in relation to the tubular rod 90, by a pair of sealing rings 43, generally elastomeric.

Thus, the filtered water flow, coming out from the upper nozzle 52 of the filter cartridge 50, passes through the interior of the tubular rod 90 and of the second head 60, to reach the filtrate radial spout 61.

Due to the fact that the passage 15 of the body 10 connects the lower nozzle 51 of the filter cartridge 50 to the cold water supply system, it is required the provision of a cock for controlling the flow of filtered water. Said filtered water cock can be provided in any of the parts defined by the body 10 and by the second head 60, that is, upstream or downstream the filter cartridge 50.

However, in the constructive solution illustrated in the drawings, it is provided a filtrate cock 70 disposed downstream the filter cartridge 50, more precisely in the interior of a median portion of the tubular rod 90.

The filtrate cock 70 is preferably defined by a sealing mechanism in the form of a replaceable cartridge, comprising a tubular body 71, having a lower end 71*a* and an upper end 71*b*, which are open, respectively, to the upper nozzle 52 of the filter cartridge 50 and to the interior of the second head 60, establishing a selective fluid communication between the filter cartridge 50 and the filtrate spout 61. Since the cartridge of the filtrate cock 70 can present any adequate construction, of the type in which a sealing means is linearly or angularly displaced against a sealing seat, said cock is represented only schematically by the contour of its tubular body 71. The lower end 71*a* of the tubular body 71 is threaded in the internally threaded median portion of the tubular rod 90 and peripherally sealed in relation to the latter by an intermediate sealing ring 71*c*.

The filtrate cock 70 further comprises an annular hub 72, which is rotatively mounted around a median portion of the tubular body 71, between the latter and the tubular rod 9D.

The annular hub 72 carries, in a removably way, the radially external end of a radial pin 73 which projects outwardly from the tubular rod 90, through a window 95 thereof, to be fitted in the interior of a radial hole 74*a* of a ring 74 mounted around the tubular rod 90, between the first and the second head 40, 60, in order to be able to rotate by an angle usually between 45° and 90°.

Between the ring 74 and the tubular rod 90 is disposed a bushing 75 over which the ring 74 may rotate between closing and opening positions of the filtrate cock 70. In the illustrated example, the radial pin 73 projects outwardly from the ring 74, in order to facilitate the user to grasp it upon operation of the filtrate cock.

The sealing between the radial pin 73 and the radial hole 74*a* of the ring 74, and between the annular hub 72 and the tubular body 71, can be obtained by the sealing rings 73*a* and 72*a*.

The upper end 71*b* of the tubular body 71 is externally threaded in the interior of an annular stop 76 which maintains the annular hub 72 axially seated on a retaining ring 77 which is housed and retained around the tubular body 71.

The annular stop 76 is seated against the annular hub 72 and against the tubular rod 90 by means of respective sealing rings 76*a* and 76*b*.

Thus, the user can control the liberation of filtered water by simply moving angularly the assembly formed by the radial pin 73, ring 74 and annular hub 72.

Nevertheless, considering that the filtrate cock 70 is positioned, in the illustrated embodiment, downstream the filter cartridge 50, there is the need to block the supply of cold water upstream the filter cartridge 50, upon replacing the latter, by uncoupling the jacket 35 in relation to the upper end 32 of the tubular column 30, with the simultaneous removal of all the elements defined by the tubular hub 36, first and second heads 40,60, service and filtrate spouts 41 e 61, tubular rod 90 and filtrate cock 70.

Thus, the present faucet further comprises a check valve 100 housed in the interior of an axial throughole 85 provided through the region of the lower end 81 of the sleeve 80.

The axial throughole 85 é inferiorly open to a central recess 86 provided in the lower end 81 of the sleeve 80, which central recess is surrounded by the sealing ring 84 and to whose interior opens the outlet end 15*b* of the passage 15 of the body 10 of the faucet. The axial throughole 85 presents a constant cross section, generally cylindrical, from the central recess 86 until its opposite upper end, where it suffers a diametral reduction defined by an inner circumferential flange 87 incorporated, usually in a single piece, to the sleeve 80. The axial throughole 85 is further internally and medianly provided with a circumferential groove 88.

The check valve 100 comprises a tubular body 101 with a lower end closed by an annular wall 102 having an inner edge incorporating a tubular projection 103 axially extending upwards, until a certain height of the tubular body 101, and in the interior of which is slidingly mounted a rod 111, with a polygonal cross section, preferably in the form of a cross, of a sealing means 110 which also incorporates a conical widened head 112, which is positioned in the interior of the tubular body 101, above the tubular projection 103.

The tubular body 101 further presents a plurality of external radial tongues 105, defining flexible tooth inclinedly turned downwards and which are fitted in the circumferential groove 88 of the sleeve 80 when the tubular body 101 is introduced in the interior of the axial throughole 85. Thus, the tubular body 101 remains axially retained, in the downward direction, in the interior of the axial throughole 85.

The tubular body 101 further presents an annular upper edge 104, onto which is seated an annular seat 120, in elastomeric material, incorporating an inner peripheral skirt 121, which projects axially downwardly, to the interior of the tubular body 101, maintaining a radial spacing in relation to the adjacent inner wall portion of the tubular body 101.

The annular seat 120 is maintained in position by a retaining ring 130, preferably in metal alloy and incorporating a lower peripheral extension 131, which is internally provided with a circumferential rib 131*a* which is fitted in the interior of an external circumferential groove 106 of the tubular body 101, said fitting being made so as to maintain aligned the external contours of the tubular body 101 and of the lower peripheral flange 131.

The retaining ring 130 carries, externally, a sealing ring 135 which is radially pressed against the inner wall of the axial throughole 85, the retaining ring 130 being further superiorly seated against the inner circumferential flange 87, allowing the upward axial locking of the check valve 100 in the interior of the axial throughole 85 of the sleeve 80.

Figure 2C:
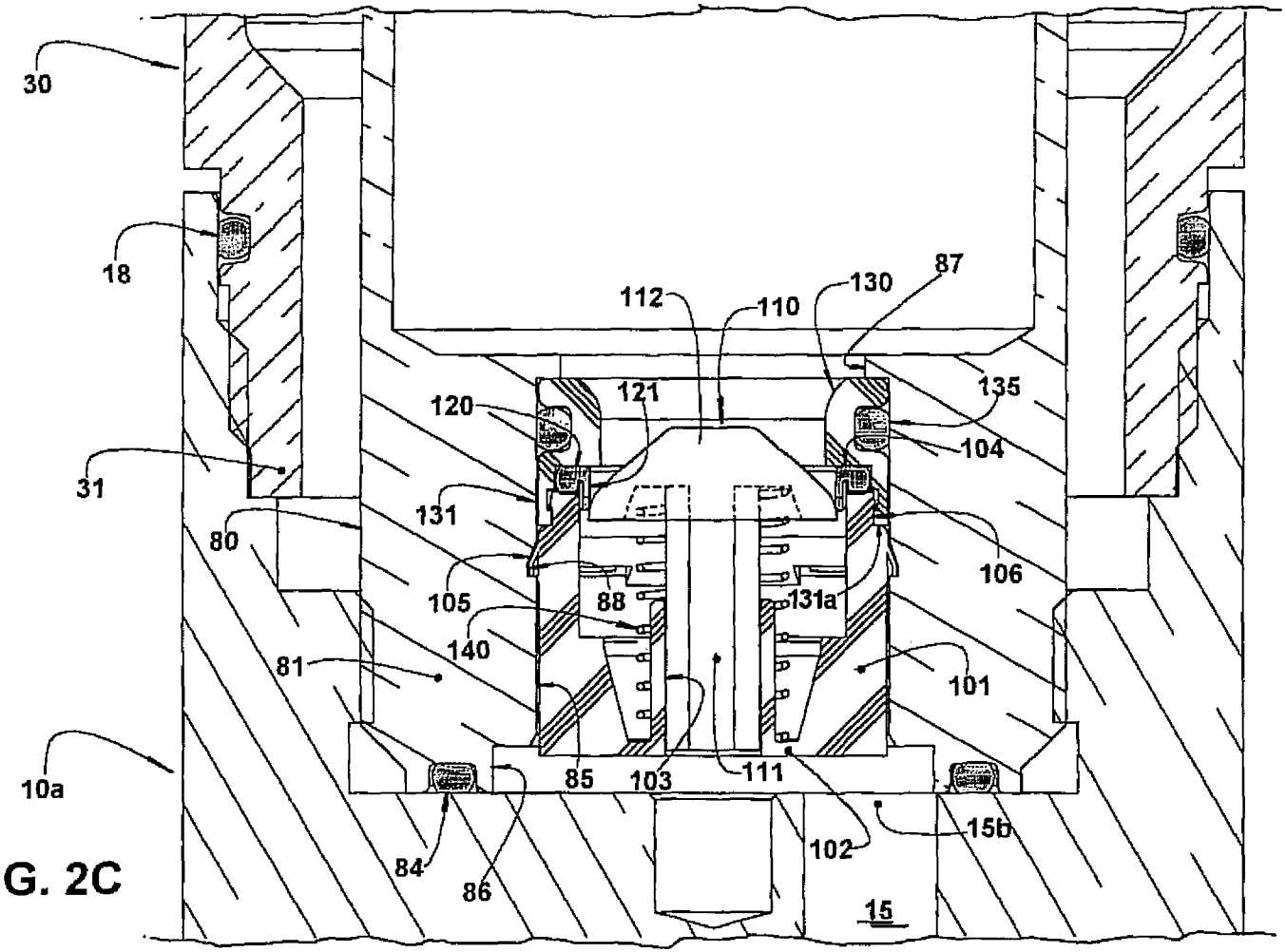
FIG. 2C represents a view similar to that of FIG. 2A, but illustrating, in an enlarged detail, the faucet without the filter cartridge and with the check valve in a closed condition.
Figure 3:
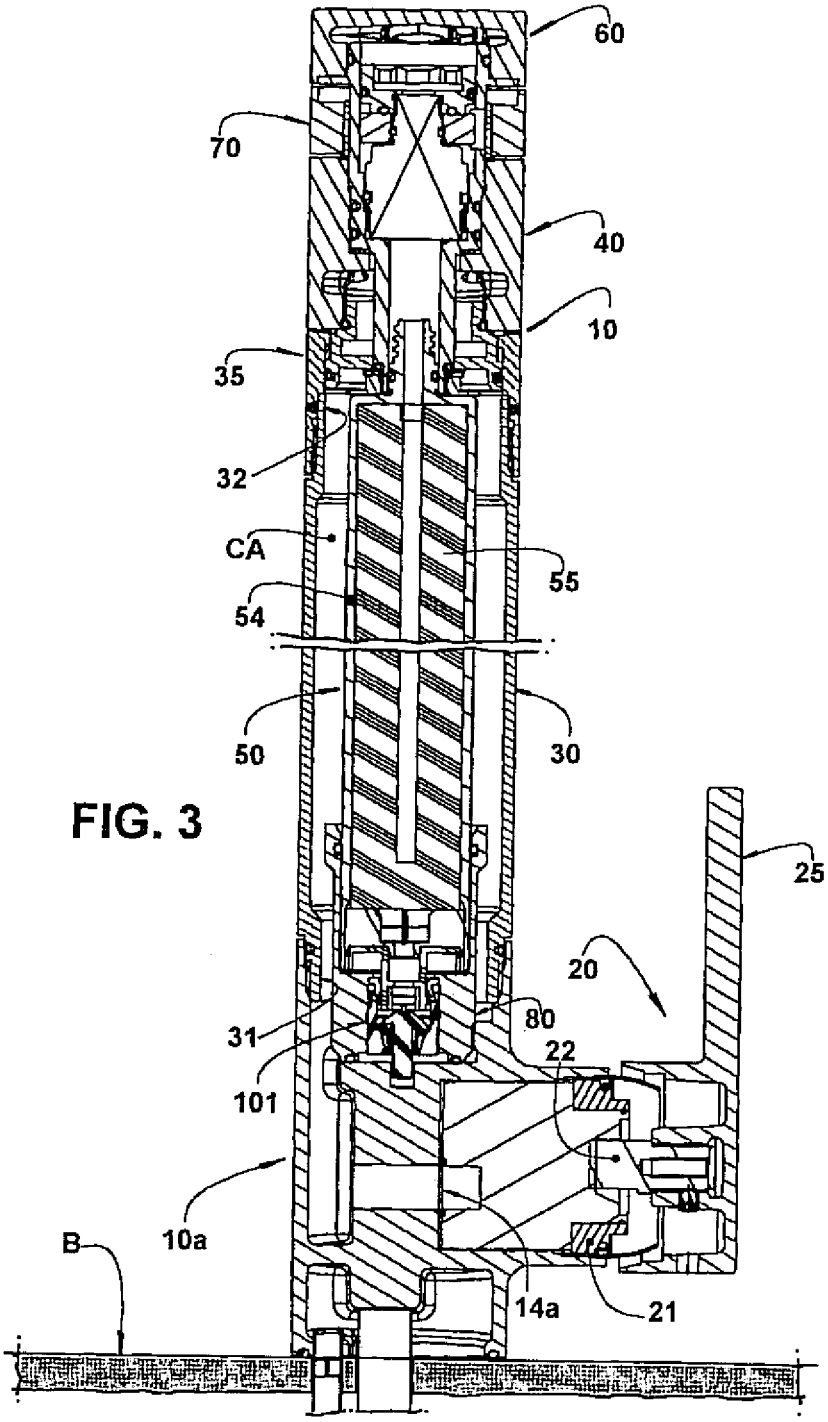
FIG. 3 represents a longitudinal sectional view of the faucet, taken according to line in FIG. 3.
Figure 3A:
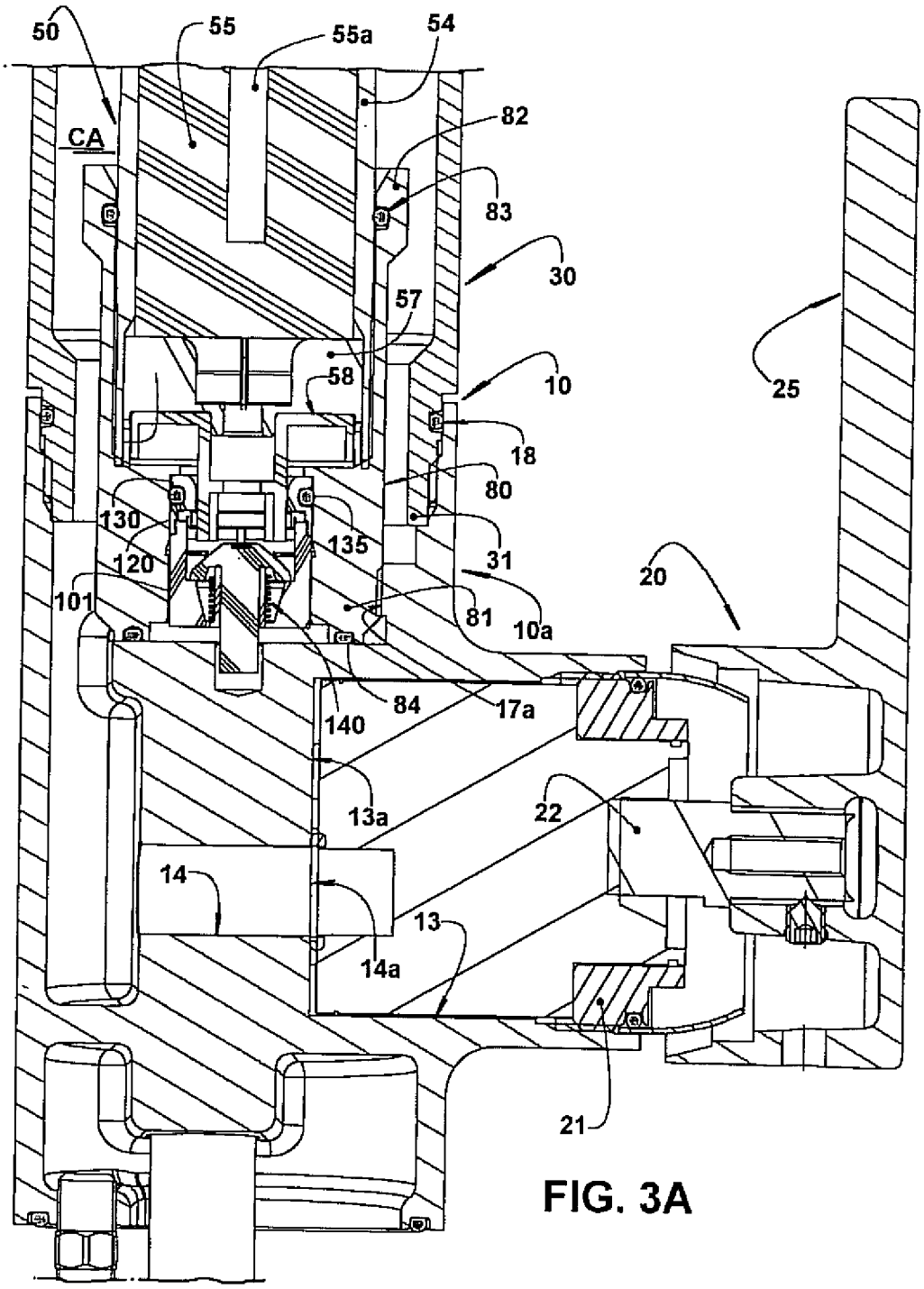
FIG. 3A represents an enlarged detail of the lower part of the faucet illustrated in FIG. 3.
Figure 3B:
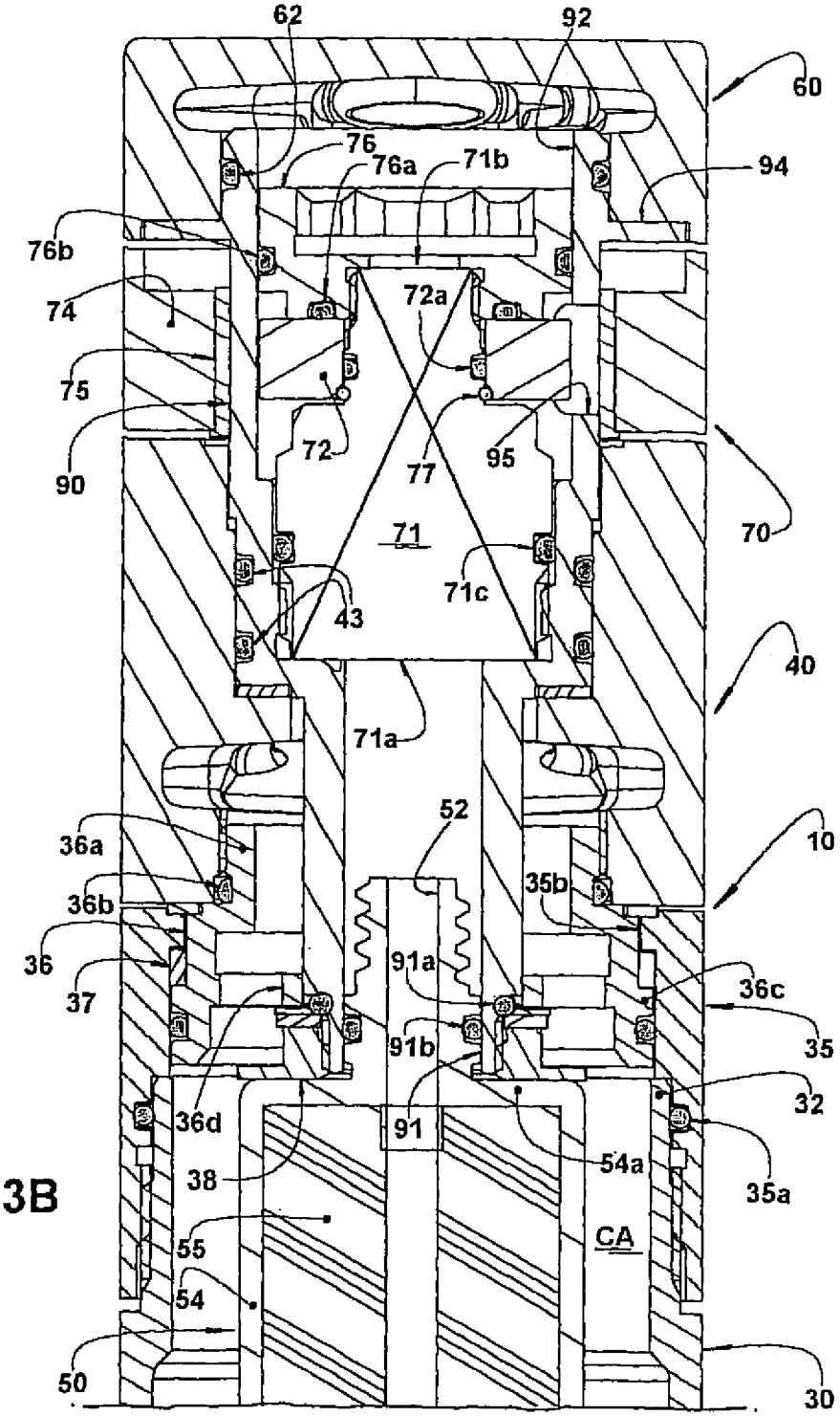
FIG. 3B represents an enlarged detail of the upper part of the faucet illustrated in FIG. 3.

Thus, when the filter cartridge 50 is removed from the interior of the tubular column 30 (see FIG. 2C), the sealing means 110 ceases to have its widened head 112 pressed downwardly, by the elements associated with the lower end 51 of the filter cartridge 50, allowing the hydraulic pressure of the cold water network to act under the widened head 112, pushing it upwardly to make it seat against the inner peripheral skirt 121 of the annular seat 120, guaranteeing the automatic closure of the check valve 100, when the filter cartridge 50 is dismounted.

In the illustrated embodiment, the sealing means 110 is constantly pressed against the annular seat 120 by a helical spring 140 inferiorly seated in the lower annular wall 02 of the tubular body 101, around the tubular projection 103 and having its upper end seated under the widened head 112 of the sealing means 110.

When the filter cartridge 50 is mounted in the interior of the tubular housing 30 (see FIG. 2A), the tubular extender 58 is downwardly forced, by the annular support 57 of the filter cartridge 50, to press the sealing means 110 downwardly, pressing the spring 140, opening the check valve 100 and allowing the cold water to flow, through the passage 15 of the body 10, to the interior of the central recess 86 of the sleeve 80 and hence, along the rod 111 of the sealing means 110 and through the interior of the tubular body 101, of the annular seat 120 of the check valve 100 and also through the tubular extender 58, to the lower end of the filter cartridge 50. If the service cock 70 is open, the flow of filtered water is then conducted to the filtrate spout 61.

While only one way of carrying out the invention has been illustrated, it should be understood that modifications of form and arrangement of the component elements of the faucet can be made, without departing from the inventive concept defined in the claim that accompany the present disclosure.

The invention claimed is:

1. A mixing faucet provided with a filter, characterized in that it comprises: a body having a cold water inlet, a hot water inlet and a service water outlet housing a monocontrol mechanism, which is displaced between closing and opening positions, in which it blocks and liberates, respectively, the fluid communication, of controllable flowrate, between at least one of the cold water inlet and hot water inlet with the service water outlet; a tubular column, having a lower end coupled to the body and open to the service water outlet, and an open upper end, onto which is mounted a first head carrying a service radial spout, which is maintained in fluid communication with the service water outlet through the tubular column; a filter cartridge mounted in the interior of the tubular column, so as to have a lower nozzle maintained in fluid communication with the cold water inlet, and an upper nozzle onto which is mounted a second head which carries a filtrate radial spout; and a filtrate cock, mounted to one of the parts of body and of second head and defining a selective fluid communication between the cold water inlet and the filtrate radial spout;

wherein:

the filtrate cock is mounted in the second head, defining a selective fluid communication between the outlet nozzle of the filter cartridge and the filtrate radial spout; and a check valve, mounted between the cold water inlet and the lower nozzle of the filter cartridge, for allowing the fluid communication between said parts only when the filter cartridge is found mounted and retained in the interior of the tubular column.

2. The mixing faucet provided with a filter, according to claim 1, characterized in that the lower nozzle of the filter cartridge is maintained in fluid communication with the cold water inlet by a passage internally provided in the body.

3. The mixing faucet provided with a filter, according to claim 2, characterized in that the tubular column has its upper end engaging, externally and tightly, a tubular jacket which carries and retains, internally, a tubular hub, around which is rotatively mounted the first head, the latter having its interior open to the interior of the service radial spout and to the interior of an annular conduct, formed between the tubular column and the filter cartridge.

4. The mixing faucet provided with a filter, according to claim 3, characterized in that it comprises a nut which is seated under the tubular hub and concentric to the upper nozzle of the tubular housing, the faucet further comprising a tubular rod, having a lower end coupled in the interior of the nut and extending upwards, through the tubular hub and through the first head, ending in an upper end, around which is rotatively mounted the second head.

5. The mixing faucet provided with a filter, according to claim 4, characterized in that the filtrate cock comprises: a sealing mechanism in the form of a replaceable cartridge, including a tubular body, having a lower end and an upper end, which are open, respectively, to the upper nozzle of the filter cartridge and to the interior of the second head; and an annular hub, rotatively mounted around the tubular body and carrying a radial pin which projects outwardly from the tubular rod, to be fitted in the interior of a radial hole of a ring mounted around the tubular rod, between the first and the second head, so that it can rotate by an angle generally between 45° and 90°.

6. The mixing faucet provided with a filter, according to claim 5, characterized in that the upper end is externally threaded in the interior of an annular stop which maintains the annular hub axially seated on a retaining ring which is housed and retained around the tubular body.

7. The mixing faucet provided with a filter, according to claim 4, characterized in that the body presents an upper face against which is seated the lower end of the tubular column and in which is provided an internally threaded axial recess, in whose bottom is defined an upper nozzle, also internally threaded, with a smaller diameter and to the interior of which is open the outlet end of the passage.

8. The mixing faucet provided with a filter, according to claim 7, characterized in that it further comprises a sleeve having a lower end engaged in the interior of the upper nozzle of the body, and an open upper end carrying, internally, an elastic sealing ring, said sleeve carrying, inferiorly, a sealing ring, axially seated and pressed against the body, in the bottom of the axial recess and in the interior of the upper nozzle, of the passage.

9. The mixing faucet provided with a filter, according to claim 8, characterized in that the filter cartridge comprises a tubular housing lodging a tubular shaped filtering element, presenting a blind axial hole which is superiorly open to the upper nozzle of the filter cartridge, defined by an upper end of the tubular housing presenting a lower end which defines the lower nozzle of the filter cartridge.

10. The mixing faucet provided with a filter, according to claim 9, characterized in that the check valve is housed in the interior of an axial throughole provided through the region of the lower end of the sleeve, said axial throughole being inferiorly open to a central recess provided in the lower end of the sleeve and surrounded by the sealing ring, and to whose interior opens the outlet end of the passage, the check valve being locked axially and upwardly in the interior of the axial throughole.

11. The mixing faucet provided with a filter, according to claim 10, characterized in that the axial throughole is internally provided with a circumferential groove, the check valve comprising a tubular body inside which is slidingly mounted a sealing means, said tubular body further presenting a plurality of external radial tongues, to be inferiorly fitted in the circumferential groove of the sleeve, and an annular upper edge onto which is seated an annular seat, said sealing means being seated against the annular seat when submitted only to forces acting in the closing direction of the check valve.

12. The mixing faucet provided with a filter, according to claim 11, characterized in that the sealing means is constantly pressed against the annular seat by a helical spring inferiorly seated on the tubular body, around the tubular projection and having its upper end acting under the sealing means.

13. The mixing faucet provided with a filter, according to claim 12, characterized in that the filter cartridge, when mounted in the interior of the tubular housing, has its lower end pressing the sealing means downwardly, pressing the spring, moving the sealing means away from the annular seat and opening the check valve.

* * * * *